US008033971B2

(12) United States Patent
Campanaro et al.

(10) Patent No.: US 8,033,971 B2
(45) **Date of Patent: *Oct. 11, 2011**

(54) ADJUSTABLE USER SUPPORT PLATFORM FOR AN INCLINABLE EXERCISE DEVICE AND METHOD OF USE

(75) Inventors: Thomas J. Campanaro, Rancho Santa Fe, CA (US); Dan McCutcheon, San Diego, CA (US)

(73) Assignee: Total Gym Global Corp., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/770,587

(22) Filed: Apr. 29, 2010

(65) Prior Publication Data

US 2010/0234199 A1 Sep. 16, 2010

Related U.S. Application Data

(63) Continuation-in-part of application No. 12/551,662, filed on Sep. 1, 2009.

(60) Provisional application No. 61/094,586, filed on Sep. 5, 2008.

(51) Int. Cl.
*A63B 26/00* (2006.01)

(52) U.S. Cl. ..... 482/142; 482/96

(58) Field of Classification Search ..... 482/95–96, 482/135, 138, 140–142, 145, 908
See application file for complete search history.

(56) References Cited

U.S. PATENT DOCUMENTS

| | | | | |
|---|---|---|---|---|
| 3,892,404 | A * | 7/1975 | Martucci | 482/96 |
| 4,383,684 | A * | 5/1983 | Schliep | 482/96 |
| 4,911,438 | A | 3/1990 | Van Straaten | |
| 5,169,363 | A | 12/1992 | Campanaro | |
| 5,263,913 | A * | 11/1993 | Boren | 482/96 |
| 5,938,571 | A | 8/1999 | Stevens | |
| 5,967,955 | A * | 10/1999 | Westfall et al. | 482/142 |
| 6,692,412 | B2 * | 2/2004 | Chen et al. | 482/96 |
| 7,270,628 | B2 * | 9/2007 | Campanaro et al. | 482/95 |
| 7,503,880 | B2 * | 3/2009 | Campanaro et al. | 482/96 |
| 7,766,801 | B2 * | 8/2010 | Campanaro et al. | 482/96 |
| 2007/0093369 | A1 | 4/2007 | Bocchicchio | |

OTHER PUBLICATIONS

International Search Report and Written Opinion dated Apr. 9, 2010 for PCT/US2009/055605.

* cited by examiner

*Primary Examiner* — Fenn Mathew
(74) *Attorney, Agent, or Firm* — Stephen C. Beuerle; Procopio Cory Hargreaves & Savitch LLP

(57) ABSTRACT

A method of using an adjustable user support platform with an inclinable exercise device includes providing an adjustable user support platform movably attached to an adjustable incline of the inclinable exercise device for movement of the adjustable user support platform along the adjustable incline, the adjustable user support platform including a support platform frame with a support platform and a support frame, the support platform frame operably coupled to the support frame for adjustably inclining the support platform frame with support platform relative to the support frame; inclining the support platform frame with the support platform relative to the support frame to a desired tilt angle; and securing the support platform frame with the support platform at the desired pivot angle relative to the support frame.

13 Claims, 11 Drawing Sheets

ADJUSTABLE USER SUPPORT PLATFORM FOR AN INCLINABLE EXERCISE DEVICE AND METHOD OF USE

CROSS-REFERENCE TO RELATED APPLICATION

This application is a Continuation-In-Part of co-pending application Ser. No. 12/551,662 filed on Sep. 1, 2009, which claims the benefit of provisional patent application 61/094,586, filed Sep. 5, 2008 under 35 U.S.C. 119(e), and each of the aforementioned patent applications is incorporated by reference herein as though set forth in full.

FIELD OF THE INVENTION

The present invention relates to an exercise device. More particularly, the present invention relates to an adjustable user support platform for inclinable exercise device wherein the exerciser exerts muscle force against an adjustable portion of the exerciser's own body weight.

BACKGROUND OF THE INVENTION

Inclinable exercise devices such as that shown in U.S. Pat. No. 5,967,951 in which an exerciser exerts muscle force against an adjustable portion of the exerciser's own body weight have been developed. The inventors of the present invention have recognized that it would desirable to develop a user support platform for such an exercise device that allows the exerciser to maintain neutral spine position and proper posture during exercise, achieving a safer and more functional result.

SUMMARY OF THE INVENTION

An aspect of the invention involves an adjustable user support platform for an inclinable exercise device. The inclinable exercise device includes a vertical support member, and first and second sets of rails each having a first end and a second end. The first ends of the first set of rails are pivotally connected to, and adjustably supported by, the vertical support member. The first ends of the second set of rails are connected to the second end of the first set of rails. A strut includes a first end pivotally connected to the vertical support member and a second end pivotally connected to the rails. The adjustable user support platform includes a support surface that can be pivoted and fixed in a variety of different angles. The pivotal user support platform allows the exerciser to maintain neutral spine position and proper posture during exercise, achieving a safer and more functional result.

Another aspect of the invention involves a method of using an adjustable user support platform with an inclinable exercise device. The inclinable exercise device includes a vertical support member; an adjustable incline having a first end and a second end, the first end of the adjustable incline adjustably supported by, and vertically movable with respect to, the vertical support member for adjusting the incline of the adjustable incline. The method includes the steps of providing, based on user input, an adjustable user support platform movably attached to the adjustable incline for movement of the adjustable user support platform along the adjustable incline, the adjustable user support platform including a support platform frame with a support platform, and a support frame, the support platform frame operably coupled to the support frame for adjustably inclining the support platform frame with support platform relative to the support frame; inclining, based on user input, the support platform frame with the support platform relative to the support frame to a desired tilt angle; securing, based on user input, the support platform frame with the support platform at the desired pivot angle relative to the support frame.

One or more implementations of the aspect of the invention described immediately above include one or more of the following: receiving a user's torso against the support platform at the desired pivot angle relative to the support frame; and moving, based on user input, one's torso supported by the support platform and the adjustable user support platform along the adjustable incline; the support platform frame and the support frame define respective planes and further including movably adjusting, based on user input, the support platform frame relative to the support frame so that the plane defined by the support platform frame is substantially coplanar with the frame defined by the support frame; the adjustable user support platform includes a tilt angle adjustment mechanism, the support platform frame adjustably supported by the tilt angle adjustment mechanism for adjusting the tilt angle of the support platform frame with support platform relative to the support frame, and the method further includes adjusting, based on user input, the tilt angle of the support platform frame with support platform relative to the support frame; the support platform frame includes an upper end and a lower end, the upper end located closer to the vertical support member than the lower end, the lower end of the support platform frame adjustably supported by the tilt angle adjustment mechanism for adjusting the tilt angle of the support platform frame with support platform relative to the support frame, and the method further includes adjusting, based on user input, the tilt angle of the support platform frame with support platform relative to the support frame; at least one of the support platform frame and the support frame including support stops therein and the tilt angle adjustment mechanism includes a retractable support mechanism that is positionable at the support stops for adjusting the tilt angle of the support platform frame with support platform relative to the support frame, and the method further includes positioning, based on user input, the retractable support mechanism at one of the support stops to set the tilt angle of the support platform frame with support platform relative to the support frame; the tilt angle adjustment mechanism includes a screw-type tilt angle adjustment mechanism that is rotatably adjustable for adjusting the tilt angle of the support platform frame with support platform relative to the support frame, and the method further includes rotatably adjusting, based on user input, the screw-type tilt angle adjustment mechanism to set the tilt angle of the support platform frame with support platform relative to the support frame; the screw-type tilt angle adjustment mechanism provides infinite tilt angle adjustment, and the method includes rotatably adjusting, based on user input, the screw-type tilt angle adjustment mechanism to set the tilt angle at a tilt angle of an infinite possible tilt angles; and/or the support platform frame includes an upper end and a lower end, the upper end located closer to the vertical support member than the lower end, the support frame includes an upper end and a lower end, the upper end located closer to the vertical support member than the lower end, and the upper end of the support platform frame is pivotally coupled to the upper end of the support frame.

A further aspect of the invention involves an adjustable user support platform for an inclinable exercise device, the inclinable exercise device including a vertical support member; an adjustable incline having a first end and a second end, the first end of the adjustable incline adjustably supported by, and vertically movable with respect to, the vertical support member for adjusting the incline of the adjustable incline; including a support frame including an upper end and a lower end, the upper end located closer to the vertical support member than the lower end; a support platform frame including an upper end and a lower end, the upper end located closer to the vertical support member than the lower end, the support platform frame including a support platform, the support platform frame operably coupled to the support frame for adjustably inclining the support platform frame with support platform relative to the support frame, the support platform configured to receive a user's torso for supporting a user of the inclinable exercise device; and a tilt angle adjustment mechanism adjustably supporting the support platform frame relative to support frame for adjusting the tilt angle of the support platform frame with support platform relative to the support frame.

One or more implementations of the aspect of the invention described immediately above include one or more of the following: the support platform frame and the support frame define respective planes, and support platform frame is movable relative to the support frame to position the support platform frame so that the plane defined by the support platform frame is substantially coplanar with the frame defined by the support frame; at least one of the support platform frame and the support frame includes support stops therein and the tilt angle adjustment mechanism includes a retractable support mechanism that is positionable at the support stops for adjusting the tilt angle of the support platform frame with support platform relative to the support frame; the tilt angle adjustment mechanism includes a screw-type tilt angle adjustment mechanism that is rotatably adjustable for adjusting the tilt angle of the support platform frame with support platform relative to the support frame; and/or the upper end of the support platform frame is pivotally coupled to the upper end of the support frame. The tilt angle adjustment mechanism may alternatively include one or more lockable gas struts pivotally mounted between the support frame and support platform that are adjustable in length for adjusting the tilt angle of the support platform frame.

A still further aspect of the invention includes an inclinable exercise device including a vertical support member; an adjustable incline having a first end and a second end, the first end of the adjustable incline adjustably supported by, and vertically movable with respect to, the vertical support member for adjusting the incline of the adjustable incline; and an adjustable user support platform movably attached to the adjustable incline for movement of the adjustable user support platform along the adjustable incline. The adjustable user support platform having a support frame including an upper end and a lower end, the upper end located closer to the vertical support member than the lower end; a support platform frame including an upper end and a lower end, the upper end located closer to the vertical support member than the lower end, the support platform frame including a support platform, the support platform frame operably coupled to the support frame for adjustably inclining the support platform frame with support platform relative to the support frame, the support platform configured to receive a user's torso for supporting a user of the inclinable exercise device; and a tilt angle adjustment mechanism adjustably supporting the support platform frame relative to support frame for adjusting the tilt angle of the support platform frame with support platform relative to the support frame.

It is understood that both the foregoing general description and following detailed description are exemplary and explanatory and are intended to provide further explanation to the invention as claimed. The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION OF PREFERRED EMBODIMENTS

Figure 1:
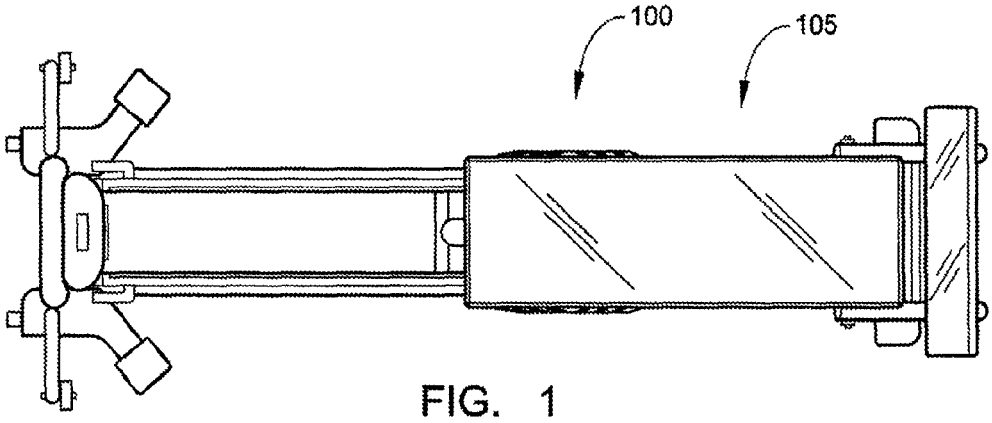
FIG. 1 is a top plan view of an embodiment of an inclinable exercise device including a pivotal user support platform shown disposed in its "normal" orientation.
Figure 2:
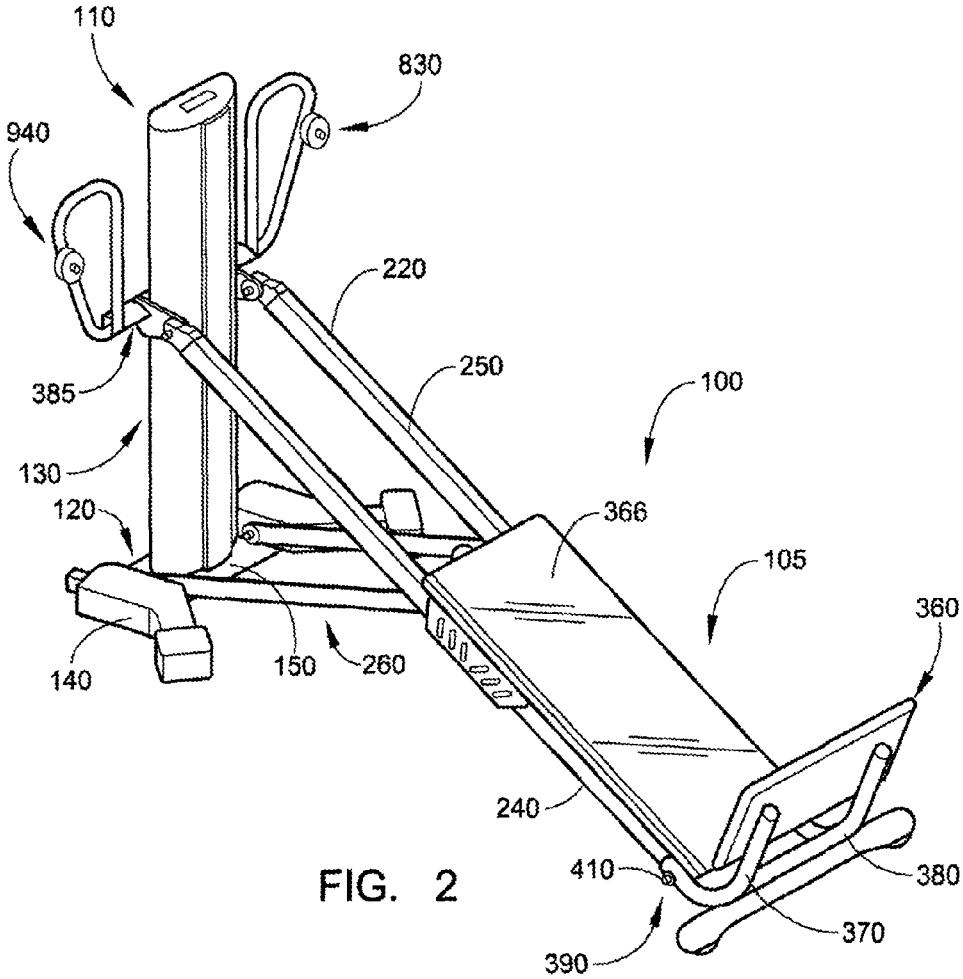
FIG. 2 is a front perspective view of the inclinable exercise device shown in FIG. 1.
Figure 3:
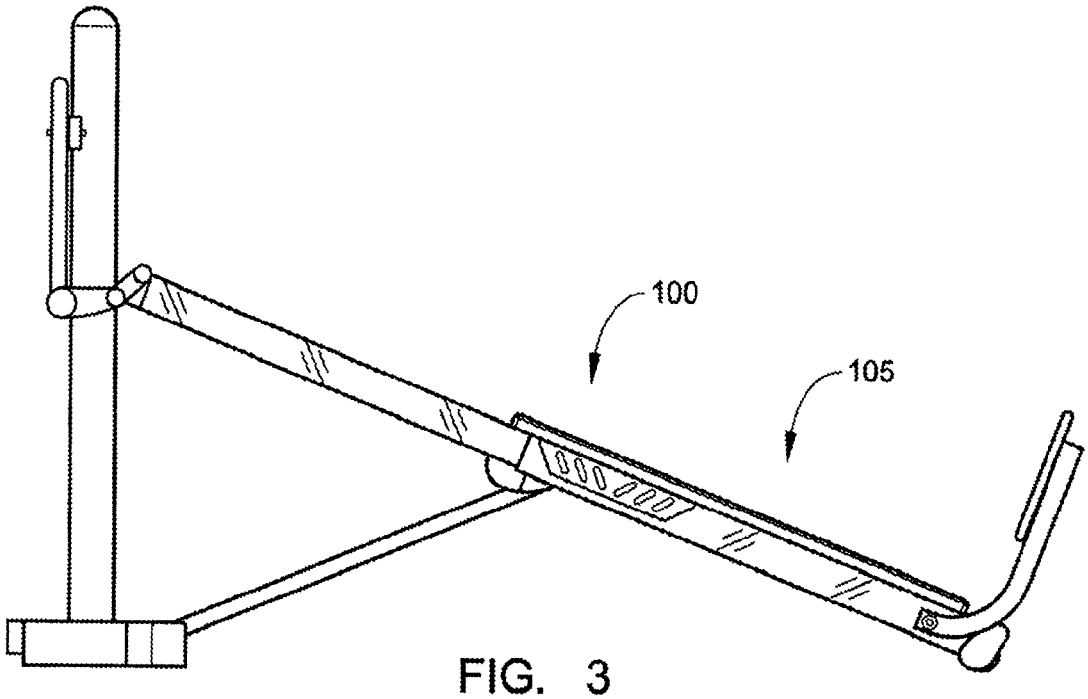
FIG. 3 is a left side-elevational view of the inclinable exercise device shown in FIG. 1.
Figure 4:
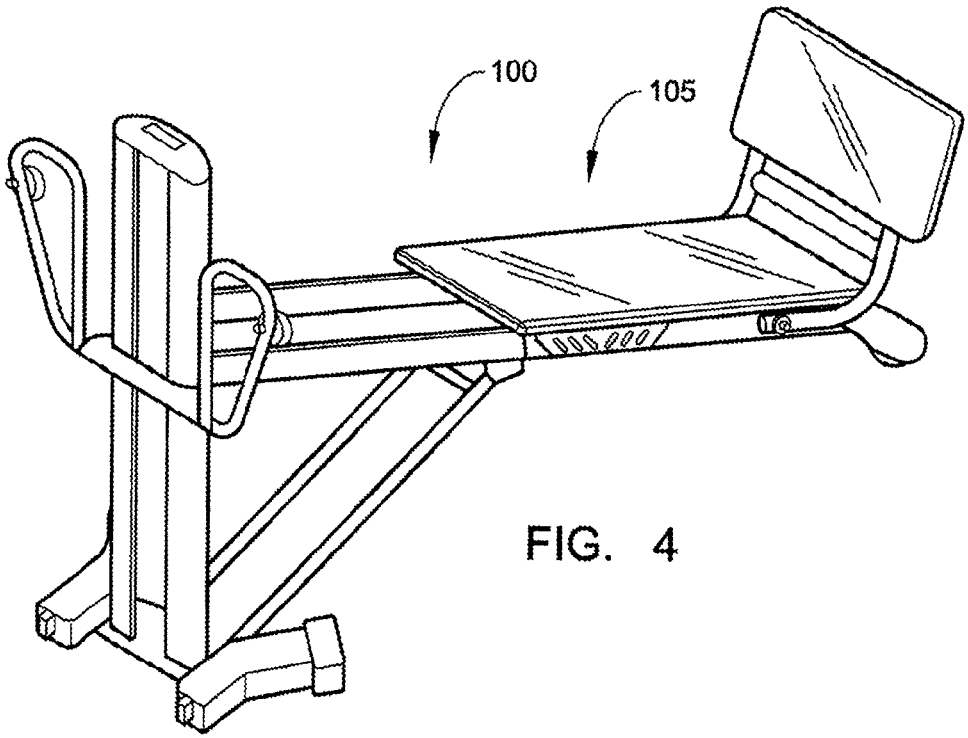
FIG. 4 is a rear perspective view of the inclinable exercise device shown in FIG. 1.
Figure 5:
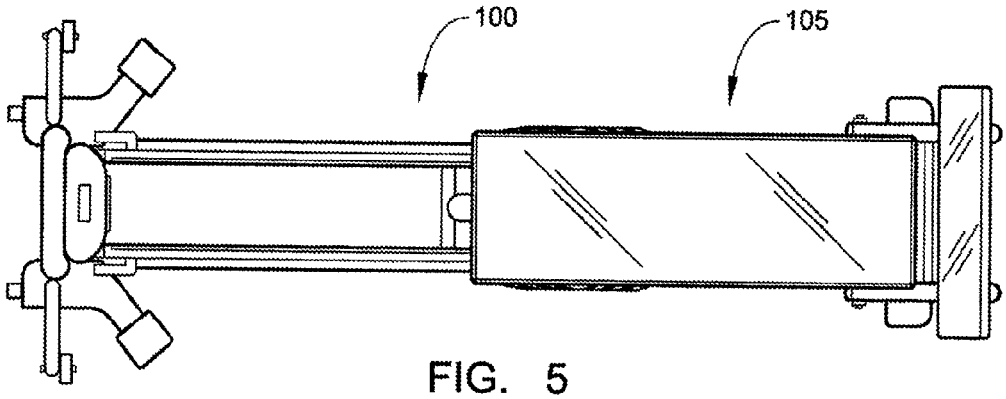
FIG. 5 is a top plan view of an embodiment of an inclinable exercise device including a pivotal user support platform shown disposed in its "angled" orientation.
Figure 6:
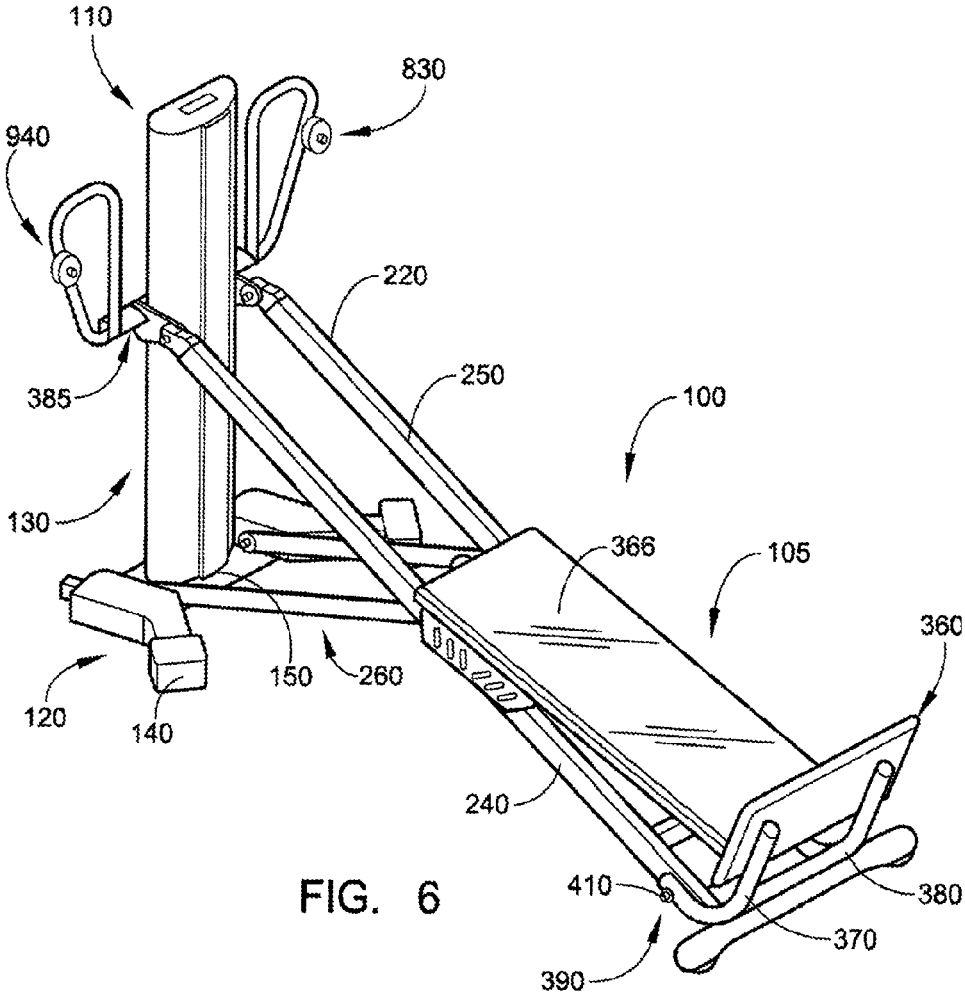
FIG. 6 is a front perspective view of the inclinable exercise device shown in FIG. 5.
Figure 7:
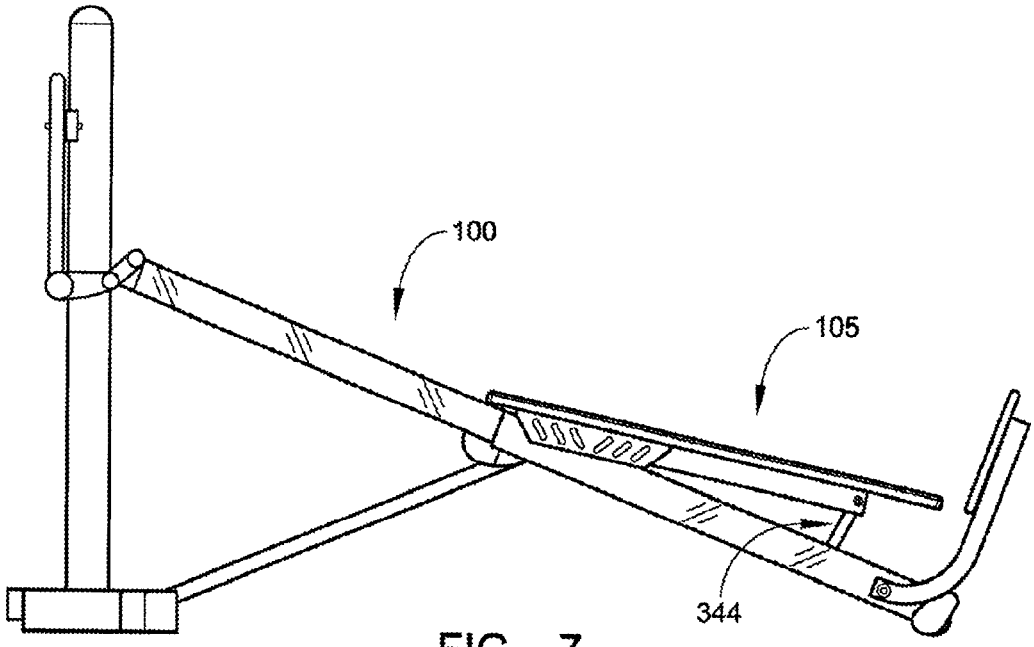
FIG. 7 is a left side-elevational view of the inclinable exercise device shown in FIG. 5.
Figure 8:
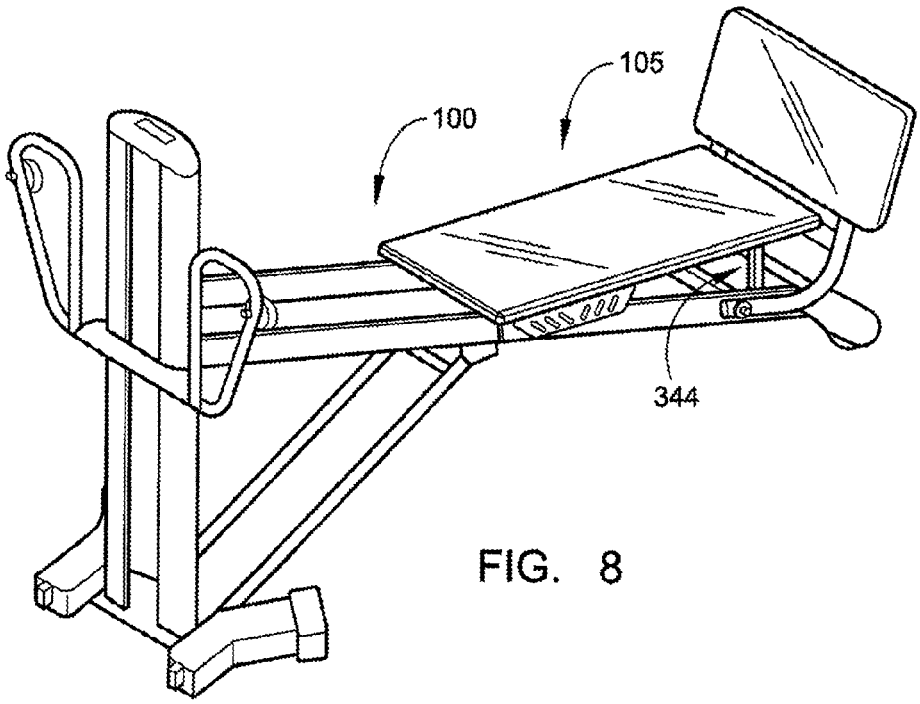
FIG. 8 is a rear perspective view of the inclinable exercise device shown in FIG. 5.

With reference to FIGS. 1-3, an embodiment of an inclinable exercise device 100 includes an adjustable, pivotal, tiltable user support platform 105. Before describing the pivotal user support platform 105, the inclinable exercise device 100 will be generally described.

The inclinable exercise device 100 includes a vertical support member or tower 110 having a base 120 and a tower housing 130. The base 120 includes a pair of opposite foot-shaped base members 140 joined by an intermediate base section 150.

The tower housing 130 extends from the intermediate base section 150 of the base 120. The tower housing 130 includes a motorized lift mechanism to lift and lower (and adjust the angle of) the collapsible exercise device 100. In alternative embodiments, the collapsible exercise device 100 includes a non-motorized lift assist mechanism or no lift assist mechanism for assisting the user in adjusting the angle/inclination of the collapsible exercise device 100.

A pair of upper rails 250 are connected to lower rails 240. A strut (or struts_260 is/are pivotally connected to the base 120 and is also pivotally connected to the rails 250, 240 at rail pivot points 230. The rails 250, 240 support the slidable/movable pivotal user support platform 105.

A folding squat platform 360 is shown in an unfolded state. The folding squat platform 360 includes opposite parallel rails 370 joined by perpendicularly extending cross rail 380. A pivot portion 390 carries a spring-loaded pull pin 410 for locking the folding squat platform 360 within a pin hole near a distal end of the lower rails 240.

Folding, combination pulley-support and pull-up bars 830 are respectively pivotally connected to mounting mechanisms 385 at proximal ends 220 of the upper rails 250. The mounting mechanisms 385 move up and down with the motorized lifting mechanism for raising and lowering the rails 240, 250. Each bar 830 has a trapezoidal configuration. For normal use, the bars 830 may be moved to the position shown in FIGS. 1-6. For performing chin ups and related exercises, the bars 830 may be moved to a position where the bars 830 are generally parallel with the rails 240, 250.

Pulleys 940 are slidably attached to the bars 830. An exerciser may move each pulley 940 to a desired position on the bar 830.

A connector extends through the pulleys 940 and connects to the pivotal user support platform 105. The connector may be of any suitable well-known type, but is preferably a cable. The cable includes handles (connected via links) at each end and extends through the pulleys 940 positioned on the combination pulley-support and pull-up bars 830 and loops through a third pulley attached to the pivotal user support platform 105. The third pulley is positioned along the lateral centerline of the pivotal user support platform 105. This position allows for unilateral (i.e. one arm), bilateral (i.e., two arm) and static equilibrium (i.e. holding the pivotal user support platform 105 suspended by keeping a constant force on each handle) use. The cable should preferably be of sufficient length to extend through the pulleys 940 and allow the exerciser to grasp one or both of the handles while the exerciser is on the pivotal user support platform 105 and the pivotal user support platform 105 is at rest.

In an alternate embodiment, the connector may be two separate cables extending through the pulleys 940 with each cable fixedly attached to the pivotal user support platform 105.

Figure 9:
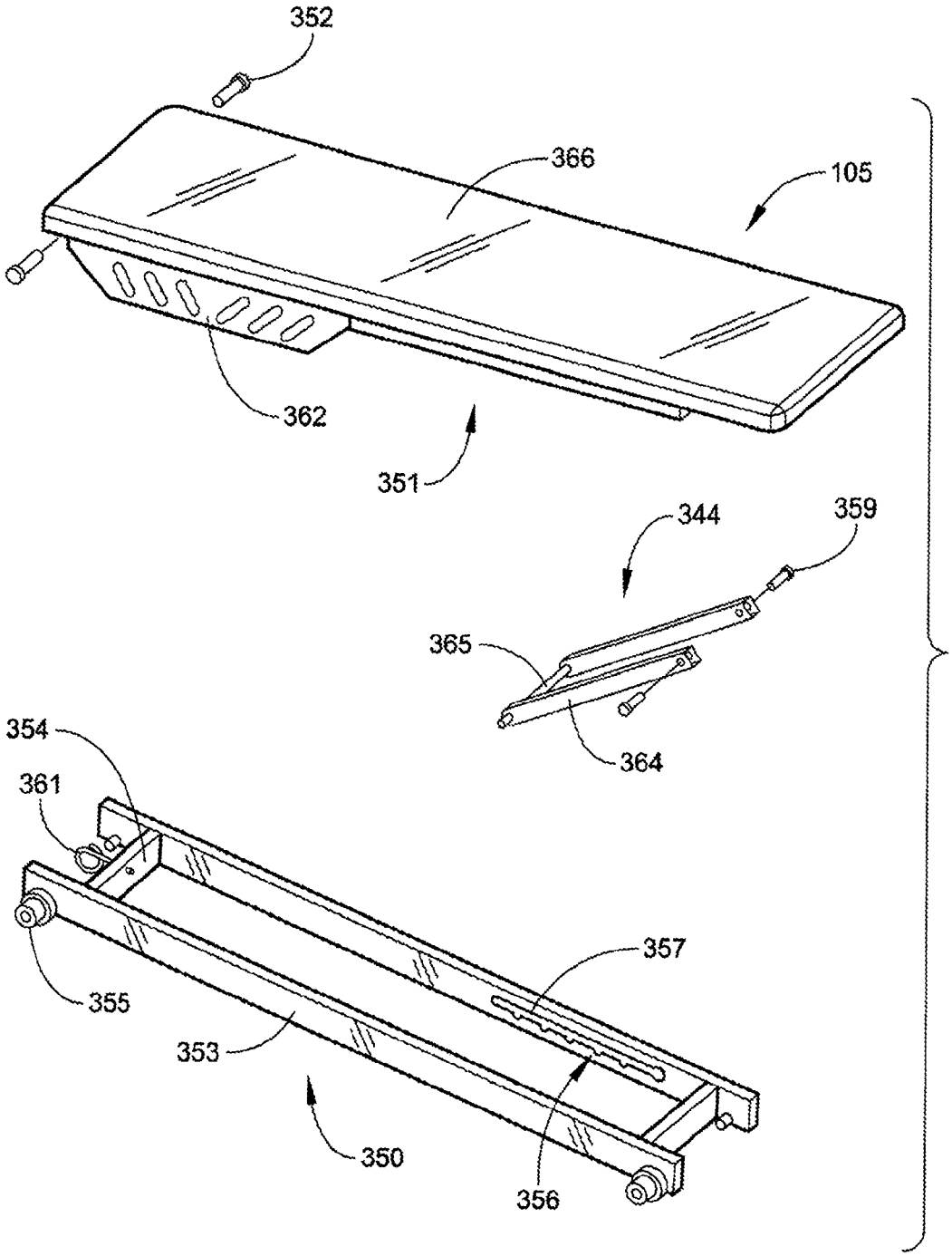
FIG. 9 is an exploded perspective view of an embodiment of the pivotal user support platform.

With reference to FIG. 9, the pivotal user support platform 105 will now be described in more detail. The pivotal user support platform 105 includes a support frame 350 and a glide board/support platform frame 351 pivotally connected to the support frame 350 at adjacent ends via a pivot mechanism. The pivot mechanism includes pivot pins 352 disposed through holes in the adjacent ends of the support frame 350 and the glide board frame 351.

The support frame 350 includes elongated parallel longitudinal rails 353, and a pair of transverse rails 354 (one of which includes hook member 361) connecting the longitudinal rails 353. Near opposite ends of the longitudinal rails 353, rollers 355 are provided for rolling movement of the pivotal user support platform 105 on the rails 240, 250. Along an inner side of the transverse rails 353, a notched groove 356 with multiple support notches 357 are disposed.

Figure 10:
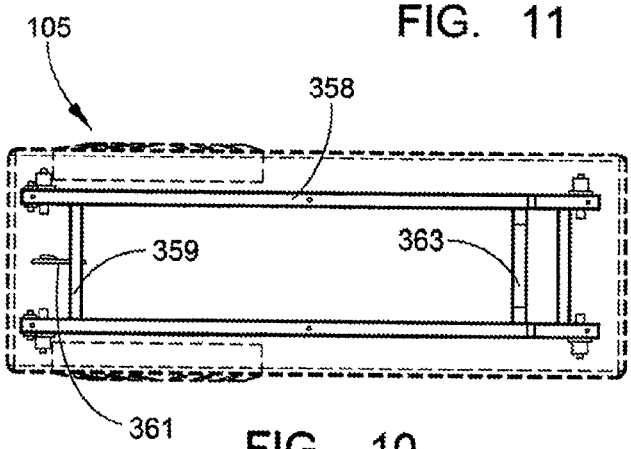
FIG. 10 is a top plan view of the pivotal user support platform of FIG. 9.

With reference to FIG. 10, the glideboard frame 351 includes elongated parallel longitudinal rails 358, and upper brackets 362 and a lateral bracket 363 attached to the elongated parallel longitudinal rails 358. A tilt angle adjustment mechanism in the form of a retractable support mechanism 344 is pivotally attached to the elongated parallel longitudinal rails 358 and the lateral bracket 363.

With reference to FIG. 913, the retractable support mechanism 344 includes parallel support rails 364 connected at an end by a support bar 365. The support rails 364 are pivotally connected to the elongated parallel longitudinal rails 358 and the lateral bracket 363 via pivot pins 359.

A main support pad/support platform 366 is attached to and supported by the glideboard/support platform frame 351. A bumper (not shown) may be positioned on the lower rails 240 to prevent the pivotal user support platform 105 from rolling all the way down the lower rails 240.

In use, the exerciser positions himself or herself on the pivotal user support platform 105 and grasps one or both of the handles. The exerciser then draws one or both of the handles toward the exerciser and by doing so transports the pivotal user support platform 105 up along the lower rails 240 and upper rails 250.

Using the motorized lift mechanism, the height of the proximal ends 220 of the upper rails 250 (via the mounting mechanisms 385) are raised and lowered, varying the angle of inclination of the rails 250, 240. The adjustment of this angle of inclination alters the percentage of the exerciser's weight which the exerciser's muscles are moving. This allows for adjustment of the intensity of the exerciser's workout.

An exerciser may also vary the resistance while working upper body muscles by positioning him or herself on the pivotal user support platform 105 with the exerciser's feet on the squat stand 350 or floor. The legs and lower body then provide assistance in moving the pivotal user support platform 105, lessening the load on the upper body muscles. The exerciser may also use the squat stand 360 to perform the squat exercise for the lower body muscles.

Figure 11:
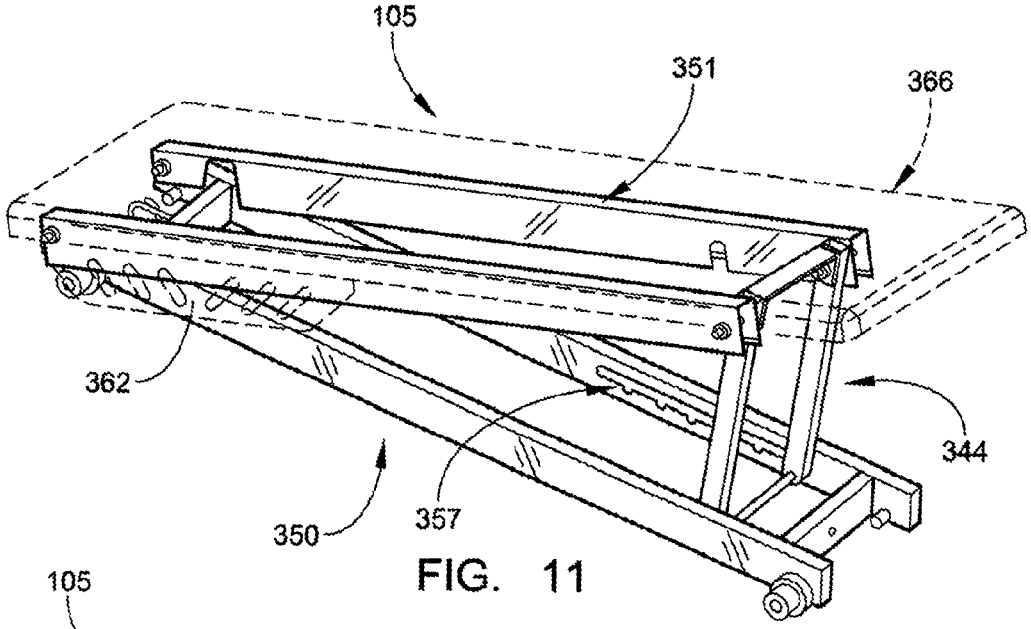
FIG. 11 is a perspective plan view of the pivotal user support platform of FIG. 9.
Figure 12:
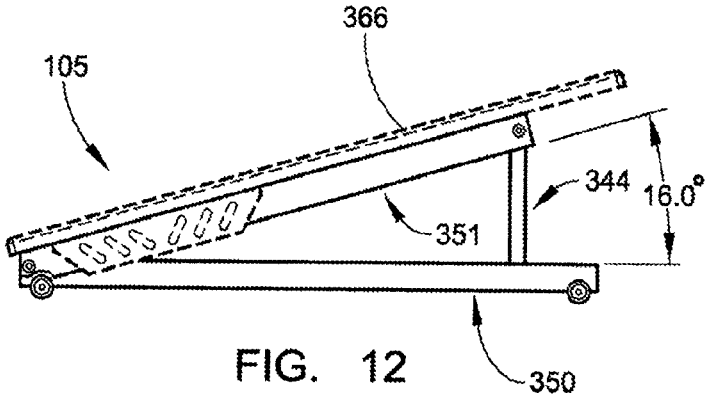
FIG. 12 is a front elevational view of the pivotal user support platform of FIG. 9.
Figure 13:
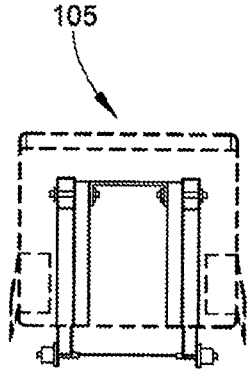
FIG. 13 is a right side elevational view of the pivotal user support platform of FIG. 9.

The exerciser may adjust/move the tilt angle of the pivotal/tiltable user support platform 105 by pivoting/tilting the glideboard frame 351 and the main support pad 366 (about pivot pins 352) relative to the support frame 350. The angle of the glideboard frame 351 and the main support pad 366 relative to the support frame 350 is locked into place at the desired tilt angle using the retractable support mechanism 344 (the support bar 365 is set in the appropriate notches 357). Setting the support bar 365 in the different notches 357 allows for 4, 8, 10, 12, 14, and 16 degrees of tilt relative to the support frame 350. With the glideboard frame 351 and the main support pad 366 pivoted upwards relative to the support frame 350, the retractable support mechanism 344 at the bottom/lower end of pivotal user support platform 105 is pivoted/moved between a "normal" retracted orientation (where a plane defined by the glideboard frame 351 and a plane defined by the support frame 350 are substantially parallel and substantially coplanar and the support bar 365 is fully disposed inwardly, toward center of glideboard frame 351 (in the notched groove 356) to a "supported" position (FIGS. 11, 12) where the glideboard frame 351 and the main support pad 366 are supported at an angled orientation relative to the support frame 350 (the support bar 365 is set in the appropriate notches 357).

To return the pivotal user support platform 105 to the "normal" retracted orientation, the glideboard frame 351 and the main support pad 366 are pivoted upwards relative to the support frame 350 (so that the support bar 365 is no longer engaged/locked in the notches 357), and the retractable support mechanism 344 at the bottom/lower end of pivotal user support platform 105 is pivoted/moved from the "supported" position, where the support bar 365 is engaged/locked in the notches 357, to the "retracted" position (where the support bar 365 is fully disposed inwardly, toward center of glideboard frame 351, in the notched groove 356). The glideboard frame 351 and the main support pad 366 are then pivoted/lowered to a "normal" orientation, where the glideboard frame 351 and the support frame 350 are substantially parallel and substantially coplanar.

In an alternative embodiment, the notches 357 are disposed in the glideboard frame 351 and the retractable support mechanism 344 is pivotally coupled to the end of the support frame 350, enabling the pivotal user support platform 105 to work in a similar, but opposite, manner compared to that described above.

The pivotal user support platform 105 allows the exerciser to maintain neutral spine position and proper posture, which is important during rotating exercises. The pivotal user support platform 105 makes it easier for the exerciser to maintain correct posture during certain exercises, achieving a safer and more functional result.

For neurological patients, the pivotal user support platform 105 allows them to sit on a horizontal carriage while relearning motor skills, training the proprioceptors and gaining increased proprioceptive response, needed for stability and agility. For patients rehabilitating from a stroke, the pivotal user support platform 105 also makes is easier for them to get on and off the exercise device.

Figure 14:
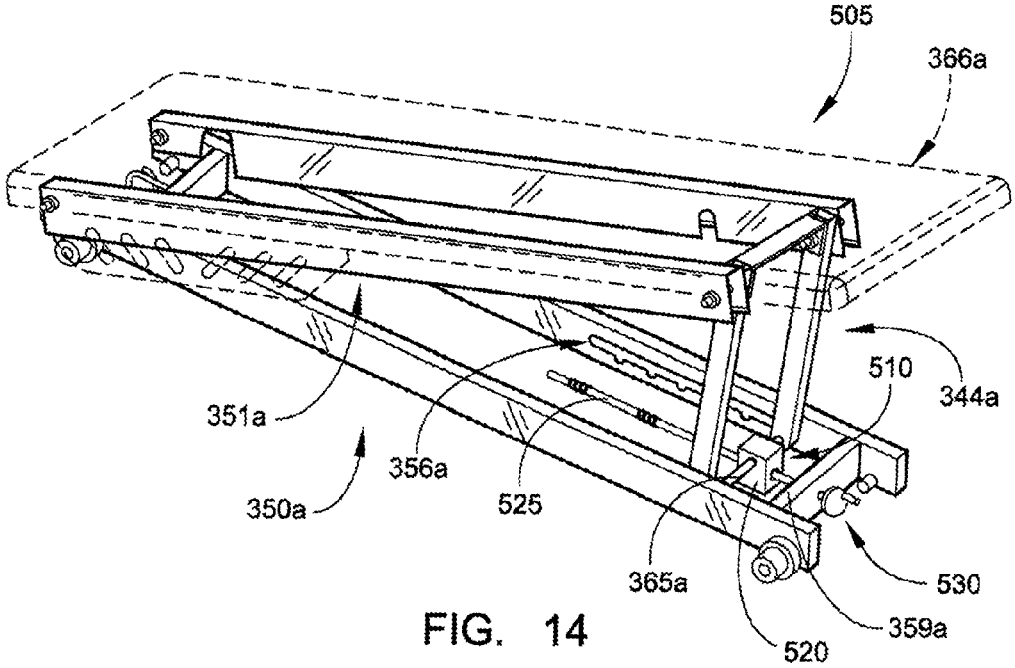
FIG. 14 is a perspective view of an alternative embodiment of a pivotal user support platform, and shows the pivotal user support platform in a fully raised/tilted configuration.
Figure 15:
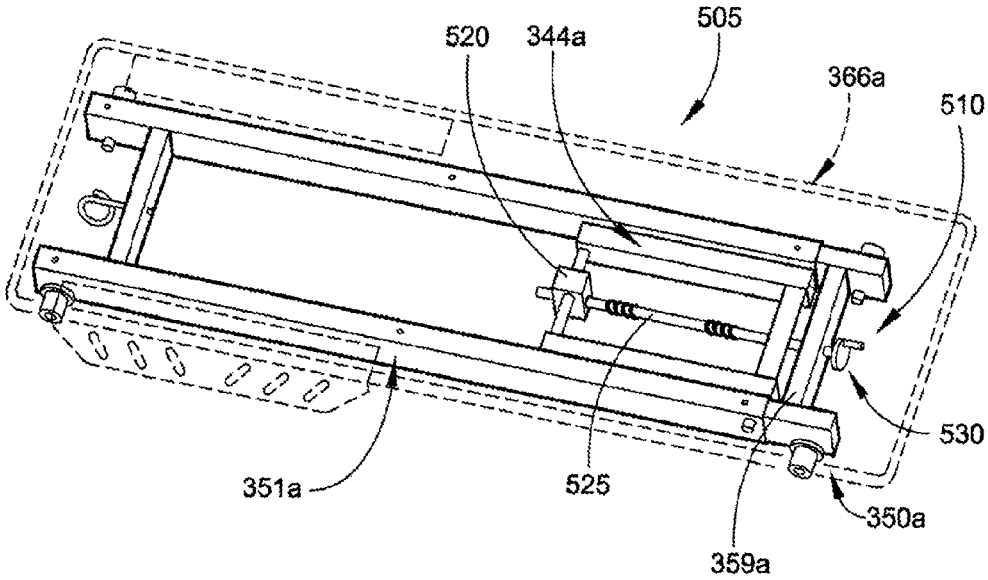
FIG. 15 is a perspective view of the pivotal user support platform of FIG. 14, and shows the pivotal user support platform in a fully compacted/flat configuration.
Figure 16:
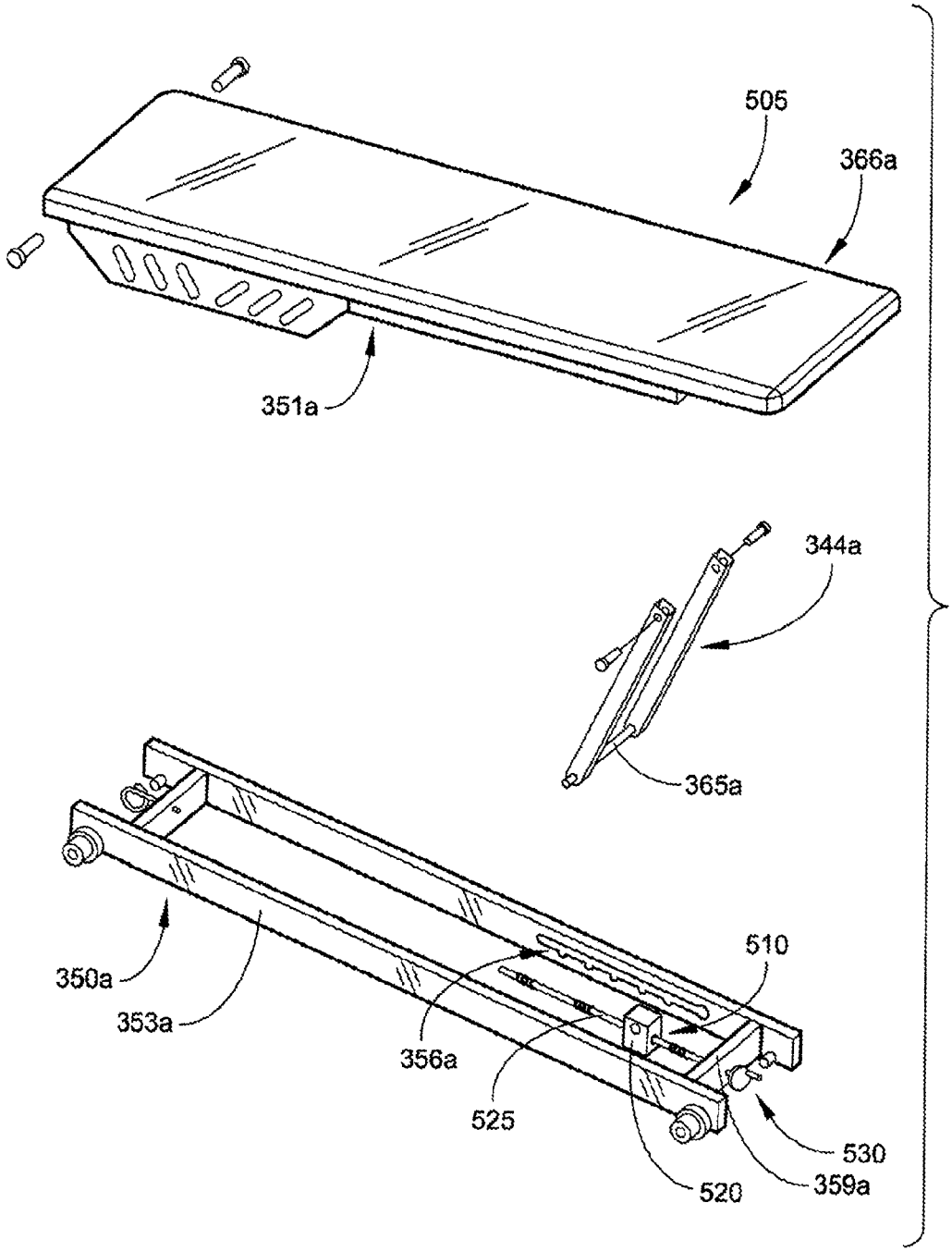
FIG. 16 is an exploded perspective view of the pivotal user support platform of FIG. 14.

With reference to FIGS. 14-16, an alternative embodiment of a pivotal user support platform 505 that provides infinite tilt adjustment (i.e., infinite tilt angles) between 0 degrees and 18 degrees will be described. The infinite adjustment pivotal user support platform 505 includes a tilt angle adjustment mechanism in the form of a screw-type tilt angle adjustment mechanism 510. The screw-type tilt angle adjustment mechanism 510 includes a screw block 520 with a threaded interior bore that threadably receives an externally threaded screw shaft 525. A proximal portion of the screw shaft 525 is rotatably disposed in a hole of transverse rail 359*a*, and the screw shaft 525 is in the same plane as a plane defined by support frame 350*a* (and parallel with longitudinal rails 353*a* of the support frame 350*a*). A proximal end of the screw shaft 525 includes a hand crank 530. In an alternative embodiment, the tilt angle adjustment mechanism 510 includes a remote-controlled motorized screw-type tilt angle adjustment mechanism instead of a manually controlled screw-type tilt angle adjustment mechanism. Support bar 365*a* extends laterally through another bore in the screw block 520 and is connected to a bottom of retractable support mechanism 344*a*. Opposite ends of the support bar 365*a* are slidably and guidably disposed in smooth guide groove 356*a*. In an alternative embodiment, the screw-type tilt angle adjustment mechanism 510 and the groove 356*a* are substantially disposed in the glide board frame 351*a* instead of the support frame 350*a*, enabling the pivotal user support platform 505 to work in a similar, but opposite, manner compared to that described above.

In use, an exerciser adjusts the tilt angle of the glide board frame 351*a* and the main support pad 366*a* relative to the support frame 350*a* by operating the screw-type tilt angle adjustment mechanism 510. Clockwise and counter-clockwise rotation of the externally threaded screw shaft 525 via the hand crank 530 causes the screw block 520 to move forward or rearward relative to the longitudinal direction of the support frame 350*a*. This causes the bottom of the retractable support mechanism 344*a* to also move forward or rearward with the ends of the support bar 365*a* being guidably disposed in the guide groove 356*a*. As the bottom of the retractable support mechanism 344*a* moves longitudinally relative to the support frame 350*a*, the top of the retractable support mechanism 344*a* (along with the coupled end portions of the glide board frame 351*a* and the main support pad 366*a*) moves towards or away the support frame 350*a*, changing the tilt angle of the glide board frame 351*a* and the main support pad 366*a* relative to the support frame 350*a*. The tilt angle of the glide board frame 351*a* and the main support pad 366*a* relative to the support frame 350*a* can be set in an infinite number of tilt angles between a maximum tilt angle (e.g., 18 degrees, FIG. 14) and a minimum tilt angle (e.g., 0 degrees, FIG. 15), where the glide board frame 351*a* and the support frame 350*a* are substantially parallel and substantially coplanar.

The infinite adjustment pivotal user support platform 505 provides the exerciser with greater control of tilt angle adjustment than the pivotal user support platform 105.

Figure 17:
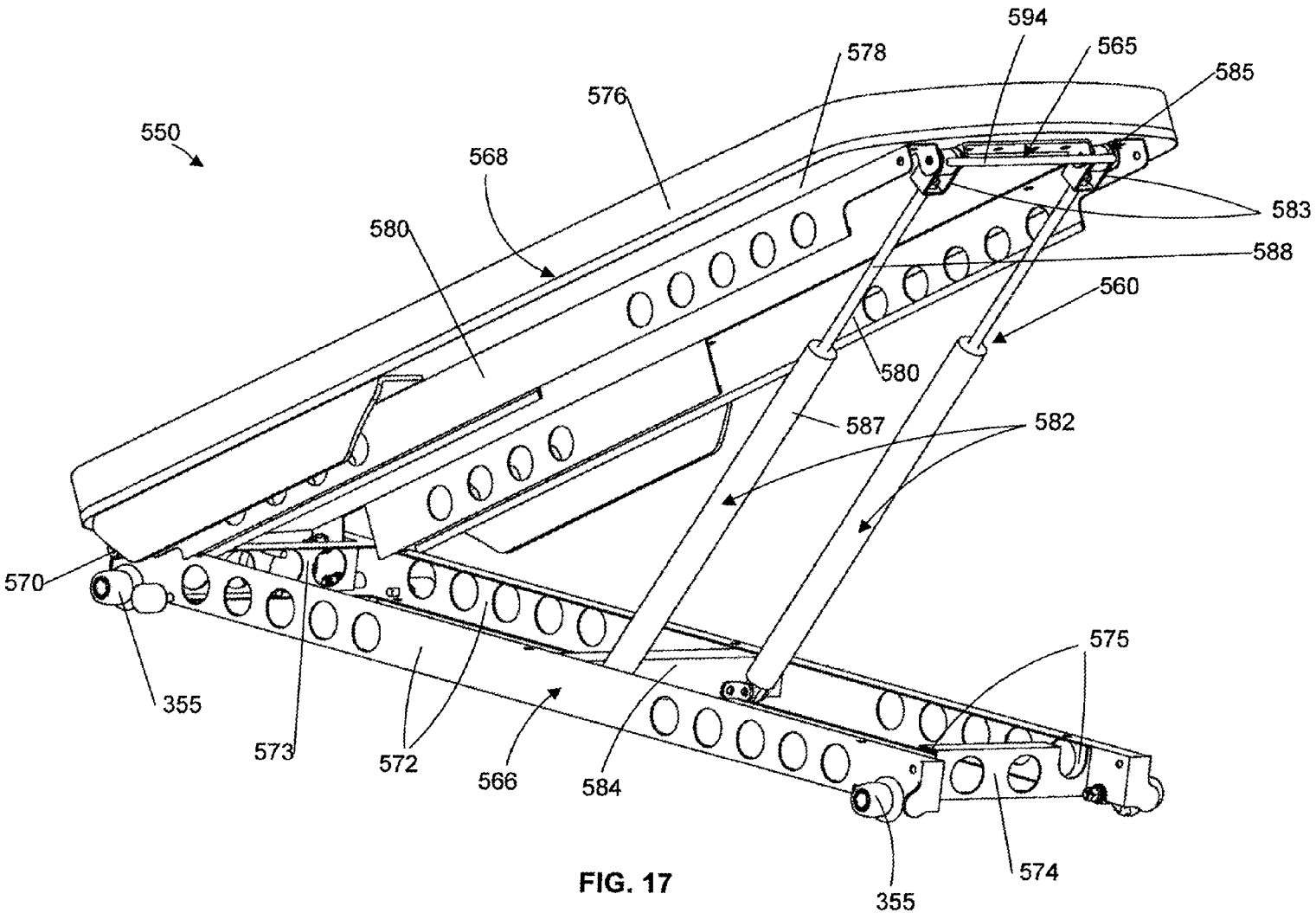
FIG. 17 is a perspective view of another alternative embodiment of the pivotal user support platform to replace the pivotal user support platform on the inclinable exercise device of FIG. 1, and shows the user support platform in a raised or tilted configuration.
Figure 18:
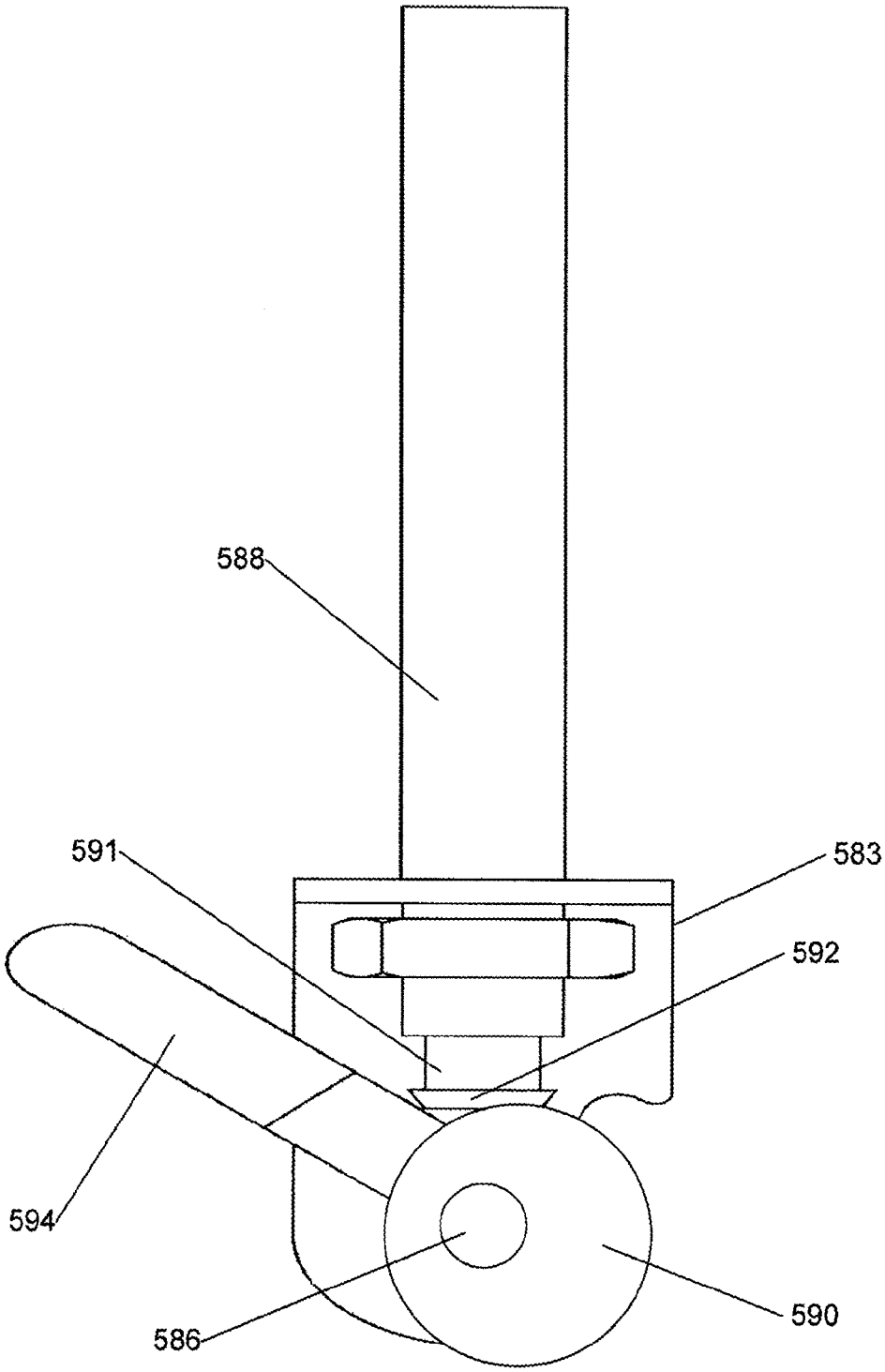
FIG. 18 illustrates the locking mechanism for the telescoping gas strut of FIG. 17 in the locked position.
Figure 19:
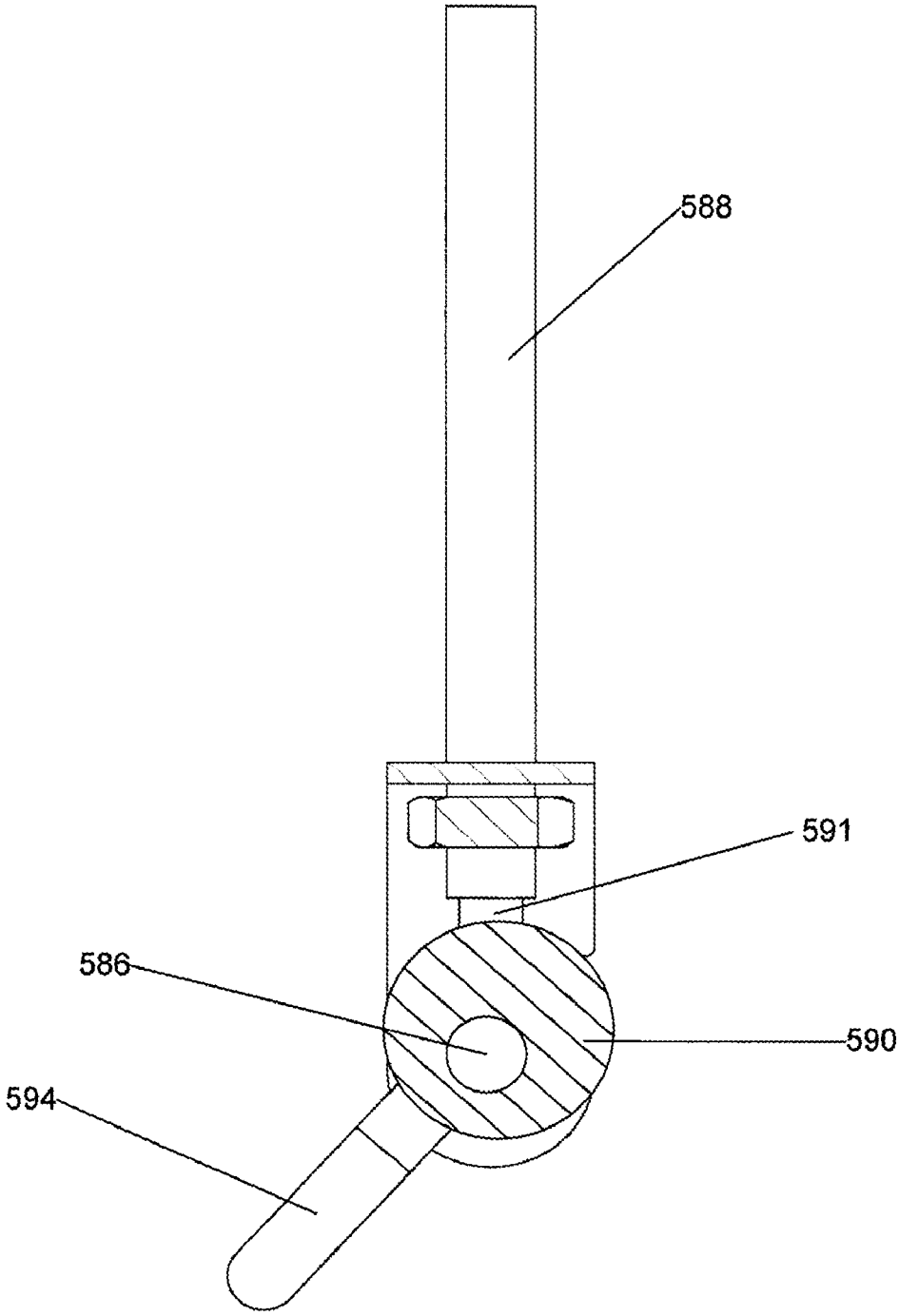
FIG. 19 illustrates the locking mechanism of FIG. 18 in the released position.

FIG. 17 illustrates another alternative embodiment of a tiltable user support platform 550 which may be used in place of the tiltable user support platform 105 on the inclinable exercise device of FIGS. 1 to 8. Tiltable user support platform 550 is similar to the platforms 105 and 505 apart from the replacement of the retractable support mechanism 344, 344*a* and the adjustment mechanism 510 of the previous embodiments with a locking gas strut adjuster 560, which also provides for continuous adjustment of the tilt angle through the entire range of angles, rather than incremental adjustment between fixed angles as in platform 105. FIGS. 18 and 19 illustrate the release mechanism 565 for the locking gas strut adjuster 560 in the locked and released positions, respectively.

As in the previous embodiments, the tiltable user support platform 550 basically comprises a base support frame 566 slidably engageable on the rails 240, 250 of the inclinable exercise device via rollers 355 at the upper and lower ends of the frame, and a glide board frame 568 pivotally mounted on the base support frame at its upper end via pivot pins 570. Glide board frame 568 is pivotable between raised, pivoted positions such as the position of FIG. 17 in which it is at an angle to the base frame and to the upper and lower rails of the inclinable exercise device, similar to user support platform 105 in the position of FIG. 6, and a folded flat position in which glide board frame is folded flat over base support frame 566 so that it is at the same angle as the adjustable rails 240,250 of the inclinable exercise device, in an equivalent position to the position of the tiltable platform 105 in FIG. 2.

Base or support frame 566 basically comprises a pair of parallel side rails 572 connected together via upper and lower cross bars 573, 574 adjacent its opposite ends. Rollers 355 are also provided adjacent the opposite ends of each side rail for movable engagement on the inclinable rails 240 and 250. Each of the rails and cross bars of support frame 566 may have a plurality of openings for reduced weight. The lower cross bar 574 has a pair of indented seats 575 adjacent its opposite ends for seating the gas strut adjuster in the folded flat condition, as explained in more detail below. The glide board frame 568 comprises a glide board platform or pad 576 mounted on a base plate 578, and a pair of parallel side rails 580 depending downwardly from base plate 578. Side rails 580 are pivotally connected to side rails 572 of the base support frame 566 adjacent their forward ends via pivot pins 570, as noted above.

The tilt angle between frames 566 and 568 is controlled by locking gas strut adjuster 560. Adjuster 560 basically comprises a pair of parallel locking gas struts 582 each pivoted at one end to a cross bar or sliding guide 584 which is slidably engaged between the opposite side rails 572 of the base support frame. The opposite ends of the gas struts are pivotally connected via pivot bracket 583 to a mounting bracket assembly 585 on the undersurface of base plate 578 adjacent the rear end of the frame 568 via pivot pins 586. Each gas strut acts as an adjustable length, pivoting link and comprises a cylinder 587 with an extendable piston rod 588 projecting from one end of the cylinder. The gas struts are of the type used on hospital beds and each have a push button 592 at the end of an actuator rod 591 which projects from one end of the strut (FIGS. 18 and 19) and which can be depressed in order to open a valve allowing fluid to flow between the chambers on opposite sides of a piston in cylinder 587. When the push button is released, rod 591 is biased into an extended position in which the valve is closed, locking the gas strut in a selected extended or retracted position. The release mechanism for operating both gas strut push buttons is illustrated in detail for one of the push buttons 592 in FIGS. 18 and 19 and is similar to that used for hospital bed adjustment. The mechanism comprises a pair of eccentrically mounted cams 590 which are mounted on mounting assembly 585 for rotation about the same pivot axis as the gas struts. Each cam engages a respective push button and the cams are connected together by handle 594. When the push button 592 is depressed, an internal valve is opened to allow fluid to leak between opposite ends of the cylinder and the gas strut will slowly extend towards its fully extended condition. Alternative release mechanisms such as a rocking or sliding lever which pushes up and down may alternatively be used.

FIG. 18 illustrates the handle 594 in the locked position in which the actuator buttons 592 are in the extended position, and the internal control valve is closed to lock the gas strut. In this cam position, a smaller portion of the eccentrically mounted cam 590 is interposed between the pivot axis and push button. When the handle 594 is rotated upwards into the released position illustrated in FIG. 19, the larger portion of each cam is rotated downward and pushes the respective button and associated actuator rod into a depressed position so that the valve is opened and gas can leak from one side of the piston to the other, allowing the lengths of the gas struts to be adjusted so that the glide board platform can be oriented at a larger or smaller angle relative to the base support frame. This allows a user to adjust the platform to the desired angle quickly and easily, simply by gripping and pulling up the handle 594, adjusting the platform position, and then rotating the handle back down to lock the struts at the desired extension. If the user wishes the glide board platform to rest flat against the base support frame, they simply release the gas struts from the locked position by rotating handle 594 upwardly, then lower the platform down as sliding guide or cross bar 584 slides towards the upper ends of side rails 572 and the glide platform side rails 580 engage over base frame side rails 572. The piston rods 588 are pushed back into the cylinders, which can be engaged in the recesses 575 in cross bar 574 when the tilt platform is folded flat against support fame 566. The struts are then locked in position by rotating the handle into the locked position of FIG. 18. This arrangement allows the tiltable glide board platform to be readily adjusted to any desired angle.

Although the pivotal user support platforms 105, 505 and 550, have been described above as being tiltable between angles of 0 degrees and as much as 18 degrees, in alternative embodiments, the pivotal user support platforms 105, 505, and 550 are tiltable between one or more alternative parameters (i.e., greater and/or less than those indicated).

Further, in alternative embodiments, the tilt angle adjustment mechanism includes a different configuration that those described/shown herein.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A method of using an adjustable user support platform with an inclinable exercise device, the inclinable exercise device including a vertical support member; an adjustable incline having a first end and a second end, the first end of the adjustable incline adjustably supported by, and vertically movable with respect to, the vertical support member for adjusting the incline of the adjustable incline; comprising:

providing, based on user input, an adjustable user support platform movably attached to the adjustable incline for movement of the adjustable user support platform along the adjustable incline, the adjustable user support platform including a support platform frame with a support platform, and a support frame, the support platform frame operably coupled to the support frame for adjustably inclining the support platform frame with support platform relative to the support frame; the support frame including a notched groove with multiple support notches, and the adjustable user support platform further including a retractable support mechanism pivotally attached to the support platform frame and including a support bar removably engageable in the multiple support notches for adjusting the tilt angle of the support platform frame with support platform relative to the support frame;

inclining, based on user input, the support platform frame with the support platform relative to the support frame to a desired tilt angle;

securing, based on user input, the support platform frame with the support platform at the desired pivot angle relative to the support frame by engaging a notch of the notched groove with the support bar.

2. The method of claim 1, further including receiving a user's torso against the support platform at the desired pivot angle relative to the support frame; and moving, based on user input, one's torso supported by the support platform and the adjustable user support platform along the adjustable incline.

3. The method of claim 1, wherein the support platform frame and the support frame define respective planes and further including movably adjusting, based on user input, the support platform frame relative to the support frame so that the plane defined by the support platform frame is substantially coplanar with the frame defined by the support frame.

4. The method of claim 1, wherein the retractable support mechanism is a tilt angle adjustment mechanism, the support platform frame adjustably supported by the tilt angle adjustment mechanism for adjusting the tilt angle of the support platform frame with support platform relative to the support frame, and the method further includes adjusting, based on user input, the tilt angle of the support platform frame with support platform relative to the support frame.

5. The method of claim 4, wherein the support platform frame includes an upper end and a lower end, the upper end located closer to the vertical support member than the lower end, the lower end of the support platform frame adjustably supported by the tilt angle adjustment mechanism for adjusting the tilt angle of the support platform frame with support platform relative to the support frame, and the method further includes adjusting, based on user input, the tilt angle of the support platform frame with support platform relative to the support frame.

6. The method of claim 4, wherein the support platform frame includes an upper end and a lower end, the upper end located closer to the vertical support member than the lower end, the support frame includes an upper end and a lower end, the upper end located closer to the vertical support member than the lower end, and the upper end of the support platform frame is pivotally coupled to the upper end of the support frame.

7. The method of claim 4, wherein the tilt angle adjustment mechanism includes at least one adjustable, locking gas strut pivotally mounted between the support platform frame and the support frame, and the step of adjusting the tilt angle of the support platform frame comprises releasing the locking gas strut, adjusting the tilt angle to a selected orientation, and locking the gas strut in the adjusted position.

8. An adjustable user support platform for an inclinable exercise device, the inclinable exercise device including a vertical support member; an adjustable incline having a first end and a second end, the first end of the adjustable incline adjustably supported by, and vertically movable with respect to, the vertical support member for adjusting the incline of the adjustable incline; comprising:

a support frame including an upper end and a lower end, the upper end located closer to the vertical support member than the lower end, the support frame including a notched groove with multiple support notches;

a support platform frame including an upper end and a lower end, the upper end located closer to the vertical support member than the lower end, the support platform frame including a support platform, the support platform frame operably coupled to the support frame for adjustably inclining the support platform frame with support platform relative to the support frame, the support platform configured to receive a user's torso for supporting a user of the inclinable exercise device;

a tilt angle adjustment mechanism in the form of a retractable support mechanism adjustably supporting the support platform frame relative to support frame for adjusting the tilt angle of the support platform frame with support platform relative to the support frame, the retractable support mechanism pivotally attached to the support platform frame and including a support bar removably engageable in the multiple support notches for adjusting the tilt angle of the support platform frame with support platform relative to the support frame.

9. The adjustable user support platform of claim 8, wherein the support platform frame and the support frame define respective planes, and support platform frame is movable relative to the support frame to position the support platform frame so that the plane defined by the support platform frame is substantially coplanar with the frame defined by the support frame.

10. The adjustable user support platform of claim 8, wherein the tilt angle adjustment mechanism includes at least one lockable gas strut between the support frame and support platform plane.

11. The adjustable user support platform of claim 10, wherein the tilt angle adjustment mechanism comprises a pair of lockable gas struts pivotally mounted between the support frame and support platform frame, the gas struts being movable between retracted and fully extended positions, and a manually operable actuator movable between a first position in which the gas struts are locked in a selected position and a second position in which the gas struts are released to allow adjustment of the platform orientation.

12. The adjustable user support platform of claim 8, wherein the upper end of the support platform frame is pivotally coupled to the upper end of the support frame.

13. An inclinable exercise device including a vertical support member; an adjustable incline having a first end and a second end, the first end of the adjustable incline adjustably supported by, and vertically movable with respect to, the vertical support member for adjusting the incline of the adjustable incline; and the adjustable user support platform of claim 8 movably attached to the adjustable incline for movement of the adjustable user support platform along the adjustable incline.

* * * * *